United States Patent [19]

Jacobs et al.

[11] 4,117,370

[45] Sep. 26, 1978

[54] DISCHARGE LAMP HAVING A GLOW DISCHARGE STARTER WITHIN THE OUTER ENVELOPE

[75] Inventors: Cornelis Adrianus Joannes Jacobs; Antonius Jozephus Gerardus Cornelis Driessen; Gerardus Antonius Petrus Maria Cornelissen, all of Eindhoven, Netherlands

[73] Assignee: U.S. Philips Corporation, New York, N.Y.

[21] Appl. No.: 778,013

[22] Filed: Mar. 16, 1977

[30] Foreign Application Priority Data

Apr. 15, 1976 [DE] Fed. Rep. of Germany ..... 7611934

[51] Int. Cl.[2] ..... H01J 7/44

[52] U.S. Cl. ..... 315/35; 315/59; 315/61; 315/73; 315/DIG. 5

[58] Field of Search ..... 315/35, 36, 61, 58, 315/71, 73, DIG. 5, 59

[56] References Cited

U.S. PATENT DOCUMENTS

| | | | |
|---|---|---|---|
| 2,369,767 | 2/1945 | Abernathy | 315/36 |
| 3,982,154 | 9/1976 | Mize et al. | 315/71 X |

*Primary Examiner*—Alfred E. Smith
*Assistant Examiner*—Charles F. Roberts
*Attorney, Agent, or Firm*—Frank R. Trifari; Robert S. Smith

[57] ABSTRACT

A high-pressure sodium vapor discharge lamp which is provided with a discharge tube and an outer envelope which envelopes this tube.

In accordance with the improvement there are disposed in the space between the discharge tube and the outer envelope both a capacitor and a glow discharge starter which are both in parallel with the discharge tube. Consequently an external lamp starter is superfluous. In addition the lamp base may be relatively small.

2 Claims, 1 Drawing Figure

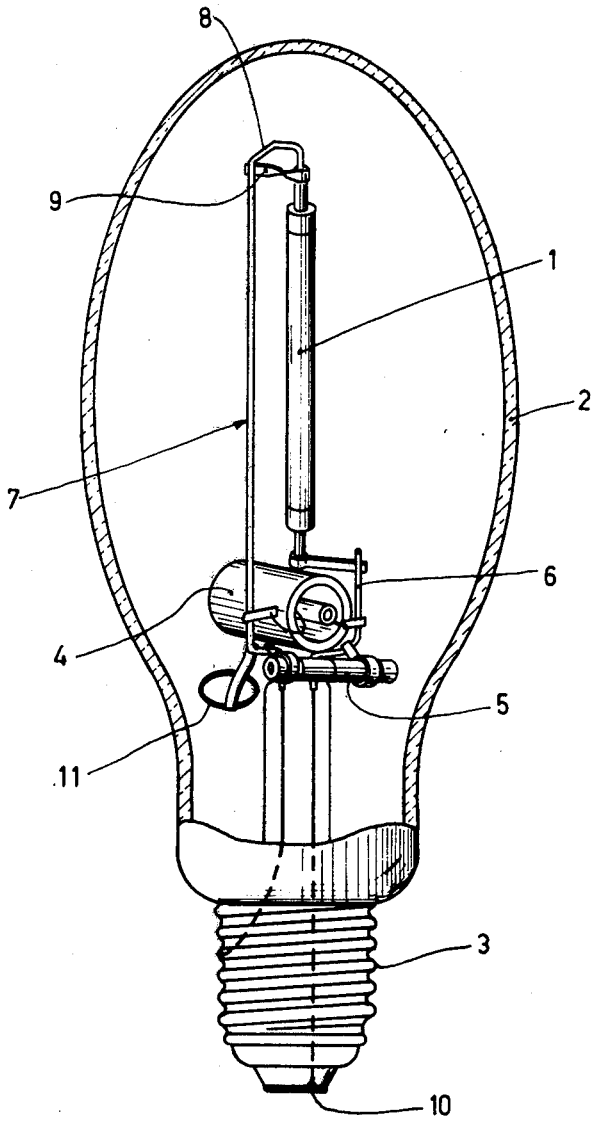
8
9
1
2
7
6
4
5
11
3
10

DISCHARGE LAMP HAVING A GLOW DISCHARGE STARTER WITHIN THE OUTER ENVELOPE

The invention relates to a discharge lamp which is provided with a main discharge tube and an outer envelope enveloping this tube, a capacitor belonging to a circuit for operating that discharge tube being disposed between that discharge tube and the outer envelope.

A discharge lamp of the type indicated is, for example, known from U.S. Pat. No. 2,369,767. A disadvantage of that known lamp is that its base is relatively large because that base also comprises an electric circuit element for igniting and feeding the discharge tube.

It is an object of the improvement to provide a discharge lamp of the type mentioned in the preamble in which a relatively small lamp base will do.

A discharge lamp according to the invention provided with a main discharge tube and an outer envelope enveloping this tube, a capacitor belonging to the circuit for operating that discharge tube being disposed between that discharge tube and the outer envelope is characterized in that also a starter discharge tube for starting a discharge in the main discharge tube is present between the main discharge tube and the outer envelope.

An advantage of this discharge tube is that it may have a relatively small base. Namely, this base need not contain further circuit elements but only feed-through conductors.

It should be noted that it is known per se to start a high-pressure discharge lamp by means of an external semiconductor starter, see for that purpose, for example, German Offenlegungsschrift No. 2,009,442. However, a disadvantage thereof is that such a starter increases the cost of installation of a lighting arrangement provided with such a lamp.

The invention is based on the notion to accommodate the circuit elements required for starting the lamp in the space between the main discharge tube and the outer envelope, that is to say not in the lamp base and also not — as an external starter — outside of the lamp.

In a discharge lamp according to the improvement the main discharge tube may, for example, be spatially located between the starter discharge tube and the capacitor.

It would be conceivable that one or both elements situated between the main discharge tube and the outer envelope are shielded from direct thermal radiation of the main discharge tube by means of a heat shield.

In a preferred embodiment of a discharge lamp according to the invention, in which this lamp is constructed as a high-pressure discharge lamp, that element of the two elements between the discharge tube and the outer envelope which is the more heat-resistant forms a shield against the direct heat rays which are directed towards the less heat-resistant element and which emerge from the main discharge tube in the operating condition of the lamp.

An advantage of this preferred embodiment is that the more heat-resistant element, for example the starter discharge tube, provided with a wall of glass then performs a dual function, for example, besides the starter function it also performs a protective function for the other element, namely the capacitor.

In a further preferred embodiment according to the invention the starter discharge tube is constructed as a glow discharge starter which is electrically in parallel with both the main discharge tube and the capacitor.

An embodiment of the invention will be further explained with reference to a drawing.

This drawing shows a perspective view — with a partly cut-away outer envelope — of a high-pressure sodium vapour discharge lamp according to the invention.

In the drawing, reference 1 represents a main discharge tube which is situated in an outer envelope 2 which envelopes the tube 1. Reference 3 indicates a base of the lamp. The total length of the lamp is approximately 17 cm and the largest width of the outer envelope 2 is approximately 7.5 cm.

Between the discharge tube 1 and the outer envelope 2 there is also a starter discharge tube, namely a glow discharge starter 4, and a ceramic capacitor 5. Both the glow discharge starter 4 and the capacitor 5 are electrically connected in parallel with the discharge tube 1. To that end both a first input terminal of the glow discharge starter 4 and a first input terminal of the capacitor 5 are connected to a first supply lead 6 of the discharge tube 1. In addition, a second input terminal of the glow discharge starter 4 and a second input terminal of the capacitor 5 are connected to a second supply lead 7 of the discharge tube 1. The supply lead 7 has at the side which faces away from the base 3 a curved portion 8, by means of which a flexible suspension of the discharge tube 1 is obtained, as well as an additional metal strip 9, which ensures the current supply. The other end of the supply lead 7 leads to the cylindrical portion of the base 3. The supply lead 6 is connected to a centre contact 10 of the base 3. Reference 11 is a getter ring for maintaining vacuum between the tube 1 and the outer envelope 2.

The depicted lamp is connected via a stabilisation inductance (not shown in the drawing) of approximately 0.6 Henry to a mains power supply of approximately 220 Volts. 50 Hz.

In a practical embodiment the lamp is a 70 Watts lamp, wherein the discharge tube 1 contains sodium, mercury and a rare gas, namely xenon. The length of the discharge tube 1 is approximately 5.5 cm and the width approximately 0.5 cm. The arc voltage of that tube 1 is approximately 90 volts.

The starting voltage of the glow discharge starter 4, which is provided with a bimetal strip is approximately 170 volts.

The capacitance of the capacitor 5 is approximately 1 nanofarad. It is a non-lacquered ceramic capacitor which is connected into the circuit by means of clamping contacts. This capacitor 5 may be non-lacquered because it is arranged in vacuum.

The described lamp has a luminous flux of approximately 5000 lumens.

The base 3 only contains two feed-through conductors and may, consequently, be relatively small. In the present case it is a so-called E-27 lamp base whose outer circumference is approximately 27 mm.

On switch-on of the lamp an electric voltage is applied between the leads 6 and 7. This produces a glow discharge in the starter 4. The generated heat causes the bi-metal strip — in that starter 4 — to bend so that the starter contacts contact each other. Then the discharge tube 1 and the capacitor 5 are short-circuited for a short while. The current is then only limited by the ballast inductance. As the bimetal in the starter 4 now cools again, the contact of the starter 4 opens shortly thereafter. This elimination of the short circuit of the capacitor 5 results in a voltage peak across inter alia the discharge tube 1, whereupon the discharge in that tube 1 is started. If this does not happen the first time, the above-described starting procedure is repeated.

After the discharge in the discharge tube 1 has started the voltage across the tube decreases and, consequently, also across the glow discharge starter, to an ultimate value of approximately 90 volts. At this voltage the glow discharge starter no longer starts, as its starting voltage is around approximately 170 volts.

A great advantage of the described lamp according to the improvement is that no external starter is required anymore and that, furthermore, the lamp base 3 can be small. This results from the fact that the two lamp-starting components, namely the glow discharge starter 4 and the capacitor 5 are disposed between the discharge tube and the outer envelope of the lamp.

The glow discharge starter 4 provided with a wall of glass furthermore protects the capacitor 5 from direct heat rays which emerge from the main discharge tube 1.

What is claimed is:

1. A discharge lamp which comprises: a main discharge tube, an outer envelope enveloping said discharge tube, a circuit for starting a discharge in said discharge tube which includes a capacitor belonging to said circuit disposed between said discharge tube and said outer envelope and a glow discharge starter which includes a bimetal strip, said glow discharge starter being disposed between said main discharge tube and said outer envelope, said glow discharge starter being connected electrically in parallel with both said main discharge and said capacitor.

2. A discharge lamp as claimed in claim 1 wherein said lamp is a high-pressure discharge lamp and wherein said glow discharge starter constitutes a shield against direct heat rays which are directed toward said capacitor and which emerge from said main discharge tube in the operating condition of said lamp.

* * * * *